US007918675B2

(12) United States Patent
Van Den Meersschaut et al.

(10) Patent No.: US 7,918,675 B2
(45) Date of Patent: Apr. 5, 2011

(54) MULTI-CONTACT CONNECTOR WITH A LOCKING PIECE INCORPORATED IN THE THICKNESS OF THE HOUSING

(75) Inventors: Bernard Van Den Meersschaut, Nazelles Negron (FR); Marnix Van Der Mee, Montlouis sur Loire (FR)

(73) Assignee: Radiall, Rosny Sous Bois (FR)

( * ) Notice: Subject to any disclaimer, the term of this patent is extended or adjusted under 35 U.S.C. 154(b) by 0 days.

(21) Appl. No.: 12/427,304

(22) Filed: Apr. 21, 2009

(65) Prior Publication Data

US 2009/0286430 A1 Nov. 19, 2009

(30) Foreign Application Priority Data

May 14, 2008 (FR) ..... 08 53099

(51) Int. Cl.
*H01R 13/625* (2006.01)

(52) U.S. Cl. ..... 439/157; 439/347

(58) Field of Classification Search ..... 439/157, 439/310, 347
See application file for complete search history.

(56) References Cited

U.S. PATENT DOCUMENTS

| | | | | |
|---|---|---|---|---|
| 4,871,323 | A | 10/1989 | Ohsumi | |
| 6,036,509 | A * | 3/2000 | Maejima | 439/157 |
| 6,045,375 | A | 4/2000 | Aoki et al. | |
| 6,183,279 | B1 * | 2/2001 | Murakami et al. | 439/157 |
| 7,179,102 | B2 * | 2/2007 | Yamashita | 439/157 |
| 7,329,138 | B2 * | 2/2008 | Van Der Mee et al. | 439/347 |
| 7,497,706 | B2 * | 3/2009 | Daudin et al. | 439/157 |
| 2004/0002240 | A1 * | 1/2004 | Konda | 439/157 |
| 2004/0121640 | A1 * | 6/2004 | Okamoto et al. | 439/347 |
| 2006/0223373 | A1 | 10/2006 | Van Der Mee et al. | |
| 2007/0207646 | A1 * | 9/2007 | Tsuji | 439/157 |

FOREIGN PATENT DOCUMENTS

| | | |
|---|---|---|
| EP | 1 708 313 A2 | 10/2006 |
| FR | 2 777 392 A1 | 10/1999 |
| FR | 2 884 059 A1 | 10/2006 |

* cited by examiner

*Primary Examiner* — Gary F. Paumen

(74) *Attorney, Agent, or Firm* — Oliff & Berridge, PLC

(57) ABSTRACT

A connection assembly comprising a first connector housing having at least one blocking element in relief, and a second housing comprising a housing body extending along a longitudinal axis and a locking cap movable relative to the housing body of the second housing perpendicularly to the longitudinal axis between a locked position and an unlocked position. The locking cap includes at least one blocking ramp in which the blocking element in relief of the first housing is capable of sliding. The housing body of the second housing presents at least one setback in its outside surface that corresponds substantially to the thickness of the locking cap in order to receive the locking cap in its locked position.

12 Claims, 2 Drawing Sheets

MULTI-CONTACT CONNECTOR WITH A LOCKING PIECE INCORPORATED IN THE THICKNESS OF THE HOUSING

FIELD OF THE INVENTION

The present invention relates to a multi-contact connector as used in particular in the field of on-board equipment for an aircraft.

BACKGROUND OF THE INVENTION

Document FR 2 884 059 in the name of the Applicant discloses a connection assembly comprising a first housing and a second housing suitable for being assembled with the first housing. The first housing comprises a housing body and a locking cap that is movable relative to the housing body between an unlocked position and a locked position.

When the locking cap is in the locked position, such an assembly presents relatively large thickness because of the presence of the three superposed parts, i.e. the first housing, the housing body of the second housing, and the locking cap. Consequently, such a connector is relatively bulky.

Consequently there exists a need to improve the connectors used for aviation applications.

OBJECT AND SUMMARY OF THE INVENTION

The invention seeks to satisfy this need and does so by means of exemplary embodiments that provide a connection assembly comprising:

- a first multi-contact connector housing including at least one blocking element in relief; and
- a second multi-contact connector housing suitable for being assembled with the first housing, preferably in releasable manner, the second housing comprising a housing body extending along a longitudinal axis and a locking cap that is movable relative to the housing body of the second housing perpendicularly to the longitudinal axis between a locked position and an unlocked position, the locking cap including at least one blocking ramp in which the blocking element in relief of the first housing can slide when the locking cap passes from the unlocked position to the locked position, in such a manner that when the locking cap is in the locked position, co-operation between the blocking element in relief and the blocking ramp secures the two housings together in a direction parallel to the longitudinal axis;

wherein the housing body of the second housing presents at least one setback in its outside surface that corresponds substantially to the thickness of the locking cap in order to receive the locking cap in its locked position.

With a connector assembly of the invention, outside dimensions are limited to the outside dimensions of the first housing and of the locking cap, the locking cap being embedded in the housing body of the second housing, thereby achieving savings in terms of overall size and weight. The invention also makes it possible to obtain a connection assembly that is protected against electromagnetic interference in satisfactory manner.

Advantageously, the housing body of the second housing presents a setback in at least one side face, better in each said face, and a setback in its top face, said setbacks corresponding substantially to the thickness of said locking cap.

In the meaning of the invention, the term "side face of the housing body" designates a face extending along the longitudinal axis of the housing body, and other than the top face or the bottom face of the housing body.

Advantageously, the bottom of a fraction of the setback in a side face of the housing body of the second housing is constituted by an opening formed in said side face.

Advantageously, the housing body of the second housing presents in its inside surface at least one longitudinal groove enabling the blocking element in relief of the first housing to slide while the first housing is being inserted into the second housing.

Advantageously, the locking cap includes at least one ledge and the outside surface of the housing body of the second housing includes at least one guide groove for guiding the locking cap and extending perpendicularly to the longitudinal axis of said housing body, the ledge and the groove being arranged to co-operate while the locking cap is passing from the unlocked position towards the locked position.

For example, the locking cap has four ledges situated respectively at the longitudinal ends of its side faces, and the housing body of the second housing includes a guide groove for guiding the locking cap at each longitudinal end of the setback in each side face.

In the meaning of the invention, the term "side face of the locking cap" designates a face extending along the longitudinal axis of the locking cap, and other than the top face of said cap.

Advantageously, the locking cap includes at least one retention tab arranged to retain the locking cap secured to the housing body of the second housing.

Advantageously, the outside surface of the first housing presents at least one longitudinal groove and the inside surface of the housing body of the second housing presents at least one longitudinal groove for guiding the first housing, said grooves being arranged to co-operate during insertion of the first housing into the housing body of the second housing.

By way of example, in the locked position, the locking cap is received completely in the setback(s) in the outside surface of the housing body of the second housing.

Other exemplary embodiments of the invention also provide a method of assembling, preferably releasably, the first and second connector housings of the connection assembly as defined above, the method comprising:

- positioning the first and second housings relative to each other while engaging:
  - the blocking element(s) in relief in the corresponding groove(s) of the inside surface of the housing body of the second housing; and
  - the longitudinal groove(s) of the outside surface of the first housing in the longitudinal groove(s) for guiding the first housing of the inside surface of the housing body of the second housing; and
- causing the locking cap to slide in translation relative to the housing body of the second housing in such a manner as to engage the blocking element(s) in relief of the first housing in the blocking ramp(s) of the locking cap in order to block the locking cap relative to the first housing.

BRIEF DESCRIPTION OF THE DRAWINGS

Other advantageous properties and characteristics of the invention appear from the following description of non-limiting embodiments thereof and from an examination of the accompanying drawings, in which.

MORE DETAILED DESCRIPTION

Figure 1:
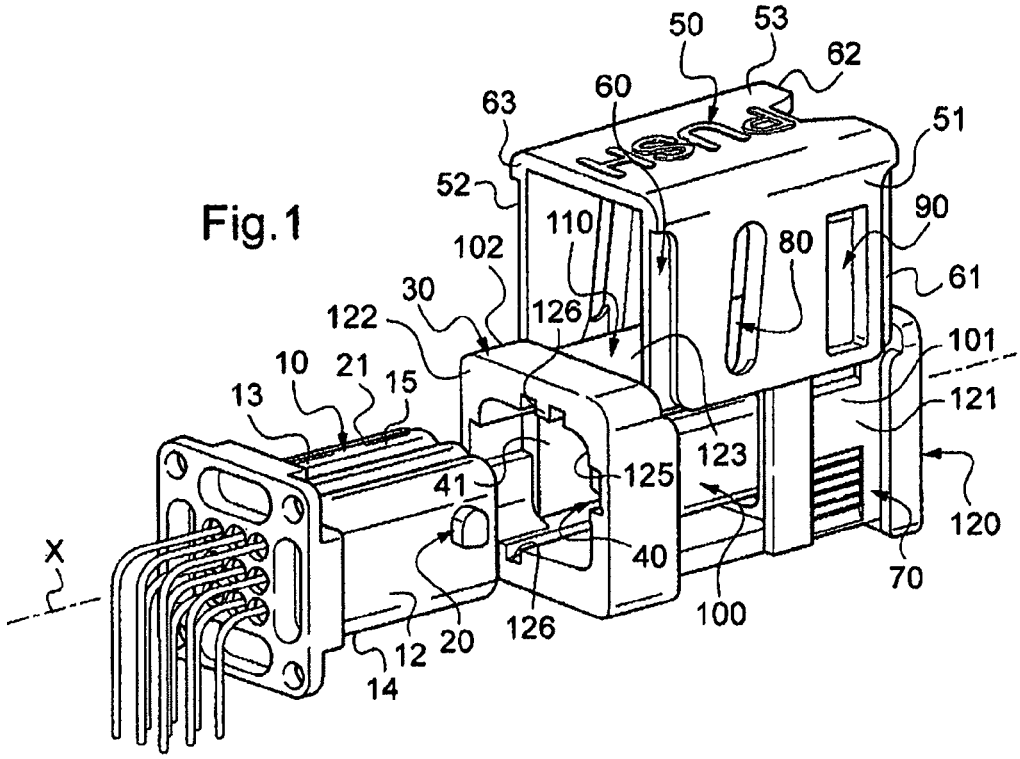
FIG. 1 is an exploded view of a connection assembly of the invention.

FIG. 1 shows an example of a connection assembly of the invention given overall reference 1.

This connection assembly comprises a first multi-contact connector housing given overall reference 10 and a second multi-contact connector housing given overall reference 30.

The first housing 10 extends along a longitudinal axis X and presents on each side face 12 and 13 a blocking element in relief 20 or 21. In the example described, these blocking elements in relief 20 and 21 are studs that perform a function as explained below.

The first housing 10 presents grooves 15 in its top face 13 and its bottom face 14, which grooves perform a function as described below.

By way of example, the first housing 10 is made of plastics material presenting a metal coating.

In the example described, the second housing 30 comprises a housing body given overall reference 120 and a locking cap given overall reference 50.

In the example described, the housing body extends along the longitudinal axis X and presents a hollow shape so as to be capable of receiving the first housing 10.

In the example described, the outside surface of the housing body 120 of the second housing presents setbacks.

The side faces 121 and 122 of the housing body 120 presents respective setbacks 101 and 102, while the top face 123 of the housing body 120 of the second housing presents a setback 110.

The bottom of a fraction of each setback 101 and 102 formed in the side faces 121 and 122 is constituted by an opening 100.

In the example shown in FIG. 1, the housing body 120 of the second housing includes guide grooves 70, 71, 72, and 73 that extend perpendicularly to the longitudinal axis X. These grooves are situated at the longitudinal ends of each setback 101 and 102 formed in the longitudinal side faces 121 and 122.

In the example described, the inside surface 125 of the housing body 120 of the second housing includes two grooves 40 and 41 that extend longitudinally and that face each other. Each groove 40, 41 is arranged to allow the corresponding blocking element in relief 20, 21 to slide while the first housing 10 is being inserted into the housing body 120 of the second housing 30.

In the example described, the inside surface 125 of the housing body 120 of the second housing also includes longitudinal grooves 126 for guiding the first housing and arranged to co-operate with the grooves 15 while inserting the first housing 10 in the housing body 120 of the second housing 30. By way of example, and as can be seen in FIG. 1, two grooves 126 may be formed in the top face 123 and one groove may be formed in the bottom face.

The outside surface of the housing body 120 of the second housing 30 also includes two guide notches (not shown) situated on either side of the longitudinal axis X to perform a function as mentioned below.

By way of example, the housing body 120 of the second housing 30 is made of plastics material presenting a metal coating.

In the example described, the locking cap 50 is U-shaped and extends along the longitudinal axis X.

The locking cap has two side faces 51 and 52 and a top face 53.

In the example described, the side faces 51 and 52 of the locking cap 50 include respective guide ramps 80 and 81 extending in a direction that makes an angle lying in the range 75° to 85° relative to the direction of the axis X.

At each longitudinal end, the side face 51 presents respective ledges 60 and 61 and the side face 52 presents respective ledges 62 and 63.

Furthermore, on each side face, the locking cap 50 has a retention tab 90 arranged to retain the locking cap secured to the housing body of the second housing by co-operating with the guide notches in the outside surface of the housing body 120 of the second housing 30.

An example of assembling a connection assembly 1 of the invention is described below with reference to FIGS. 2 and 3.

Figure 2:
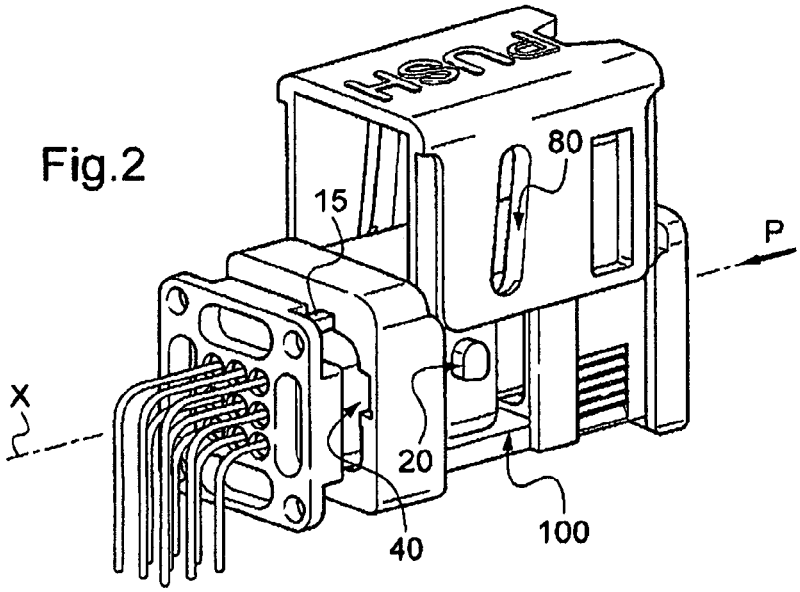
FIGS. 2 and 3 show two successive steps in assembling a connection assembly of the invention.

In a first step shown in FIG. 2, a force P is exerted along the longitudinal axis X in order to insert the first housing 10 in the housing body 120 of the second housing 30.

During this first step, the grooves 15 present at the outside surface of the housing body of the first housing lie in the grooves 126 provided at the inside surface of the housing body 120 of the second housing 30, and the blocking elements in relief 20 and 21 slide in the above-described grooves 40 and 41.

At the end of this step, the blocking elements in relief 20 and 21 project to the outside of the housing body 120 of the second housing 30 via the openings 100 formed in the bottoms of the setbacks 101 and 102 in the longitudinal sides 121 and 122.

During a second step, a force F is exerted on the locking cap 50 perpendicularly to the longitudinal axis X, thereby having the effect of causing the ledges 60, 61, 62, and 63 to slide in the above-described grooves 70, 71, 72, and 73. During this step, the blocking elements in relief 20, 21 slide in the blocking ramps 80 and 81.

Figure 3:
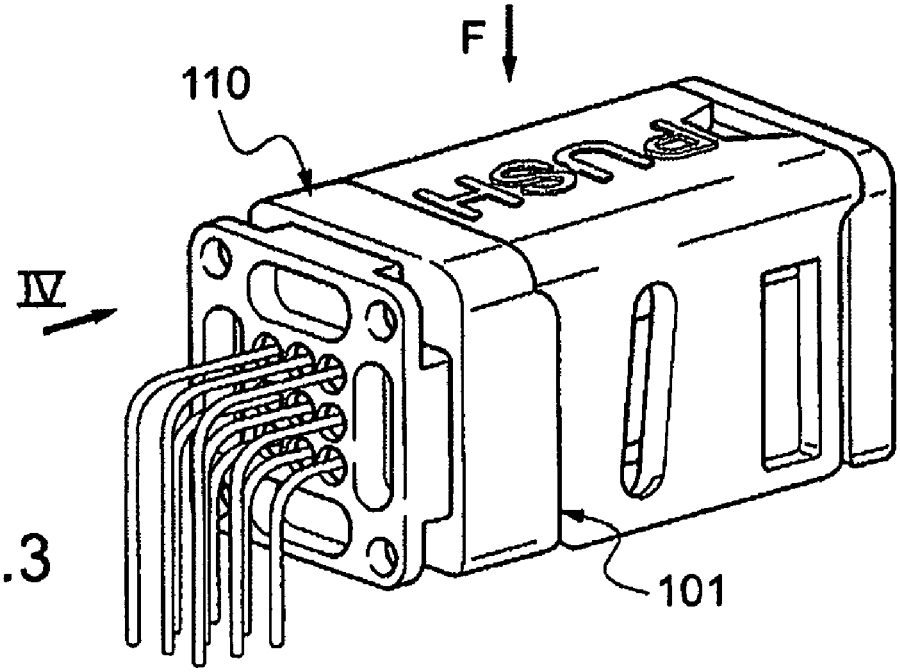
Figure 4:
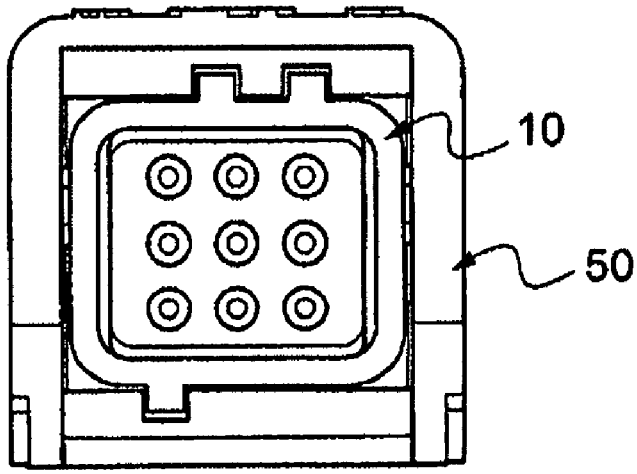
FIG. 4 is a section view on IV-IV of FIG. 3.

In this example, and as can be seen in FIGS. 3 and 4, the locking cap 50 is capable of being housed completely in the setbacks 101, 102, and 110 in the outside surface of the housing body 120 of the second housing 30, such that the overall size of the assembly thus formed corresponds only to the thickness of the first housing 10 and to the thickness the locking cap 50.

The invention thus makes it possible to obtain a connector that is relatively compact and protected against electromagnetic interference in satisfactory manner.

What is claimed is:

1. A connection assembly comprising:

a first multi-contact connector housing including at least one blocking element; and a second multi-contact connector housing suitable for being assembled with the first housing, the second housing comprising a housing body extending along a longitudinal axis, and a locking cap that is movable relative to the housing body of the second housing perpendicularly to the longitudinal axis between a locked position and an unlocked position, the locking cap including at least one blocking ramp in which the at least one blocking element of the first housing slides when the locking cap passes from the unlocked position to the locked position, in such a manner that when the locking cap is in the locked position, co-operation between the at least one blocking element and the at least one blocking ramp secures the two housings together in a direction parallel to the longitudinal axis;

wherein the housing body of the second housing (1) presents at least one setback in an outside surface of the housing body that corresponds substantially to a thickness of the locking cap, the setback being configured to fully receive the locking cap in the locked position, and (2) extends beyond the setback along the longitudinal axis at both ends.

2. An assembly according to claim 1, wherein the housing body of the second housing presents a setback in at least one side face and a setback in a top face, the setbacks corresponding substantially to the thickness of said locking cap.

3. An assembly according to claim 2, wherein a bottom of a fraction of the setback in the at least one side face of the housing body of the second housing is constituted by an opening formed in the side face.

4. An assembly according to claim 1, wherein the housing body of the second housing presents in an inside surface of the housing body at least one groove enabling the at least one blocking element of the first housing to slide while the first housing is being inserted into the second housing.

5. An assembly according to claim 1, wherein the locking cap includes at least one ledge and the outside surface of the housing body of the second housing includes at least one guide groove for guiding the locking cap and extending perpendicularly to the longitudinal axis, the at least one ledge and the at least one guide groove being arranged to co-operate while the locking cap is passing from the unlocked position towards the locked position.

6. An assembly according to claim 5, wherein the locking cap has four ledges situated respectively at longitudinal ends of side faces of the locking cap, and the housing body of the second housing includes the at least one guide groove for guiding the locking cap at each longitudinal end of the setback in each side face.

7. An assembly according to claim 1, wherein the locking cap includes at least one retention tab arranged to retain the locking cap secured to the housing body of the second housing.

8. An assembly according to claim 1, wherein the outside surface of the first housing presents at least one groove and the inside surface of the housing body of the second housing presents at least one guide groove for guiding the first housing and extending parallel to the longitudinal axis, the at least one groove and the at least one guide groove being arranged to co-operate during insertion of the first housing into the housing body of the second housing.

9. An assembly according to claim 1, wherein, in the locked position, the locking cap is received completely in the setback in the outside surface of the housing body of the second housing, such that an overall size of the assembly thus formed corresponds only to a thickness of the first housing and to the thickness of the locking cap.

10. An assembly according to claim 1, wherein in the locked position, the locking cap is embedded entirely within a profile of the housing body of the second housing.

11. An assembly according to claim 1, wherein in the locked position, the locking cap is received completely according to the longitudinal axis of the second housing in the setback in the outside surface of the housing body of said second housing.

12. A method of assembling, the first and second connector housings of a connection assembly comprising:

a first multi-contact connector housing including at least one blocking element; and a second multi-contact connector housing suitable for being assembled with the first housing, the second housing comprising a housing body extending along a longitudinal axis, and a locking cap that is movable relative to the housing body of the second housing perpendicularly to the longitudinal axis between a locked position and an unlocked position, the locking cap including at least one blocking ramp in which the at least one blocking element of the first housing slides when the locking cap passes from the unlocked position to the locked position, in such a manner that when the locking cap is in the locked position, co-operation between the at least one blocking element and the at least one blocking ramp secures the two housings together in a direction parallel to the longitudinal axis;

wherein the housing body of the second housing (1) presents at least one setback in an outside surface of the housing body that corresponds substantially to a thickness of the locking cap, the setback being configured to fully receive the locking cap in the locked position, and (2) extends beyond the setback along the longitudinal axis at both ends, the method comprising:

positioning the first and second housings relative to each other while engaging the blocking element with a corresponding groove on an inside surface of the housing body of the second housing and a groove on an outside surface of the first housing with a first housing guide groove on an inside surface of the housing body of the second housing; and causing the locking cap to slide in translation relative to the housing body of the second housing in such a manner as to engage the at least one blocking element in relief of the first housing in the at least one blocking ramp of the locking cap in order to block the locking cap relative to the first housing.

* * * * *